US005555600A

United States Patent [19]

Corson

[11] Patent Number: 5,555,600

[45] Date of Patent: Sep. 17, 1996

[54] NON-TIPPING WET/DRY VACUUM

[76] Inventor: Mary R. Corson, 501 Washington Ave., Jersey Shore, Pa. 17740

[21] Appl. No.: 406,472

[22] Filed: Mar. 20, 1995

[51] Int. Cl.[6] ..... A47L 5/36

[52] U.S. Cl. ..... 15/327.2; 15/327.6; 15/353

[58] Field of Search ..... 15/327.1, 327.2, 15/327.6, 327.7

[56] References Cited

U.S. PATENT DOCUMENTS

| | | | |
|---|---|---|---|
| 3,180,071 | 4/1965 | Nolte | 15/328 X |
| 3,320,727 | 5/1967 | Farley et al. | 15/327.1 X |
| 3,775,951 | 12/1973 | Eichholz et al. | 15/327.6 X |
| 5,353,470 | 10/1994 | Bartlett | 15/328 |
| 5,404,614 | 4/1995 | Stephens | 15/327.6 X |
| 5,440,780 | 8/1995 | Rakocy et al. | 15/327.6 X |

FOREIGN PATENT DOCUMENTS

| | | | |
|---|---|---|---|
| 25243 | 11/1930 | Australia | 15/327.6 |

*Primary Examiner*—Chris K. Moore

[57] ABSTRACT

A non-tipping wet/dry vacuum comprised of a tank having a recess formed in an upper surface thereof. The recess has an aperture with a downwardly extending portion formed therethrough. The upper portion has a hose inlet for securement of a hose thereto. The tank has a threaded aperture formed through a lower portion thereof. The threaded aperture has a plug removably secured thereto. A motor is secured within the recess in the upper portion of the tank disposed above the aperture in the recess. The motor has an electric cord extending outwardly therefrom. The motor has an on/off switch. A lid cage is secured to the downwardly extending portion from the aperture of the recess of the tank. The lid cage has a floating ball therein.

2 Claims, 4 Drawing Sheets

NON-TIPPING WET/DRY VACUUM

BACKGROUND OF THE INVENTION

1. Field of the Invention

The present invention relates to a non-tipping wet/dry vacuum and more particularly pertains to having a lower center of gravity to prevent tipping over with a non-tipping wet/dry vacuum.

2. Description of the Prior Art

The use of vacuum cleaners is known in the prior art. More specifically, vacuum cleaners heretofore devised and utilized for the purpose of efficiently cleaning are known to consist basically of familiar, expected and obvious structural configurations, notwithstanding the myriad of designs encompassed by the crowded prior art which have been developed for the fulfillment of countless objectives and requirements.

By way of example, U.S. Pat. No. 344,165 to Kuriya discloses the ornamental design for a vacuum cleaner.

U.S. Pat. No. 325,451 to Pino discloses the ornamental design for a vacuum cleaner.

U.S. Pat. No. 324,929 to Burns discloses the ornamental design for a canister vacuum cleaner.

U.S. Pat. No. 322,338 to Sovis et al. discloses the ornamental design for a vacuum cleaner.

U.S. Pat. No. 4,809,395 to Fleischhauer discloses a canister type vacuum cleaner.

U.S. Pat. No. 3,869,265 to Wolter et al. discloses a canister type vacuum cleaner.

While these devices fulfill their respective, particular objective and requirements, the aforementioned patents do not describe a non-tipping wet/dry vacuum for having a lower center of gravity to prevent tipping over.

In this respect, the non-tipping wet/dry vacuum according to the present invention substantially departs from the conventional concepts and designs of the prior art, and in doing so provides an apparatus primarily developed for the purpose of having a lower center of gravity to prevent tipping over.

Therefore, it can be appreciated that there exists a continuing need for new and improved non-tipping wet/dry vacuum which can be used for having a lower center of gravity to prevent tipping over. In this regard, the present invention substantially fulfills this need.

SUMMARY OF THE INVENTION

In the view of the foregoing disadvantages inherent in the known types of vacuum cleaners now present in the prior art, the present invention provides an improved non-tipping wet/dry vacuum. As such, the general purpose of the present invention, which will be described subsequently in greater detail, is to provide a new and improved non-tipping wet/dry vacuum and method which has all the advantages of the prior art and none of the disadvantages.

To attain this, the present invention essentially comprises a cylindrical, horizontally disposed tank having an upper portion, a lower portion, a front wall, and a rear wall. The upper portion has a recess formed therein. The recess has an aperture with a downwardly extending portion formed therethrough. The upper portion has a hose inlet inward of the front wall for securement of a hose thereto. The front wall has a threaded aperture formed therethrough adjacent the lower portion. The threaded aperture has a plug removably secured thereto. A motor is secured within the recess in the upper portion of the cylindrical, horizontally disposed tank. The motor has a filter disposed above the aperture in the recess. The motor has a plastic housing surrounded thereby. A top of the plastic housing has a plastic grid thereon. The motor has an electric cord extending outwardly of a back portion of the plastic housing. The motor has an on/off switch extending outwardly of a front portion of the plastic housing. A lid cage is secured to the downwardly extending portion from the aperture of the recess of the cylindrical, horizontally disposed tank. The lid cage has a floating ball therein. A trapezoidal ball float container is secured to the downwardly extending portion from the aperture of the recess of the cylindrical, horizontally disposed tank. The trapezoidal ball float container surrounds the lid cage for protection thereof. Four caster wheels are secured to the lower portion of the cylindrical, horizontally disposed tank.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved non-tipping wet/dry vacuum which has all the advantages of the prior art vacuum cleaners and none of the disadvantages.

It is another object of the present invention to provide a new and improved non-tipping wet/dry vacuum which may be easily and efficiently manufactured and marketed.

It is a further object of the present invention to provide a new and improved non-tipping wet/dry vacuum which is of durable and reliable construction.

An even further object of the present invention is to provide a new and improved non-tipping wet/dry vacuum which is susceptible of a low cost of manufacture with regard to both materials and labor, and which accordingly is then susceptible of low prices of sale to the consuming public, thereby making such a non-tipping wet/dry vacuum economically available to the buying public.

Still yet another object of the present invention is to provide a new and improved non-tipping wet/dry vacuum which provides in the apparatuses and methods of the prior art some of the advantages thereof, while simultaneously overcoming some of the disadvantages normally associated therewith.

Even still another object of the present invention is to provide a new and improved non-tipping wet/dry vacuum for having a lower center of gravity to prevent tipping over.

Lastly, it is an object of the present invention to provide a new and improved non-tipping wet/dry vacuum comprised of a tank having a recess formed in an upper surface thereof. The recess has an aperture with a downwardly extending portion formed therethrough. The upper portion has a hose inlet for securement of a hose thereto. The tank has a threaded aperture formed through a lower portion thereof. The threaded aperture has a plug removably secured thereto. A motor is secured within the recess in the upper portion of the tank disposed above the aperture in the recess. The motor has an electric cord extending outwardly therefrom. The motor has an on/off switch. A lid cage is secured to the downwardly extending portion from the aperture of the recess of the tank. The lid cage has a floating ball therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
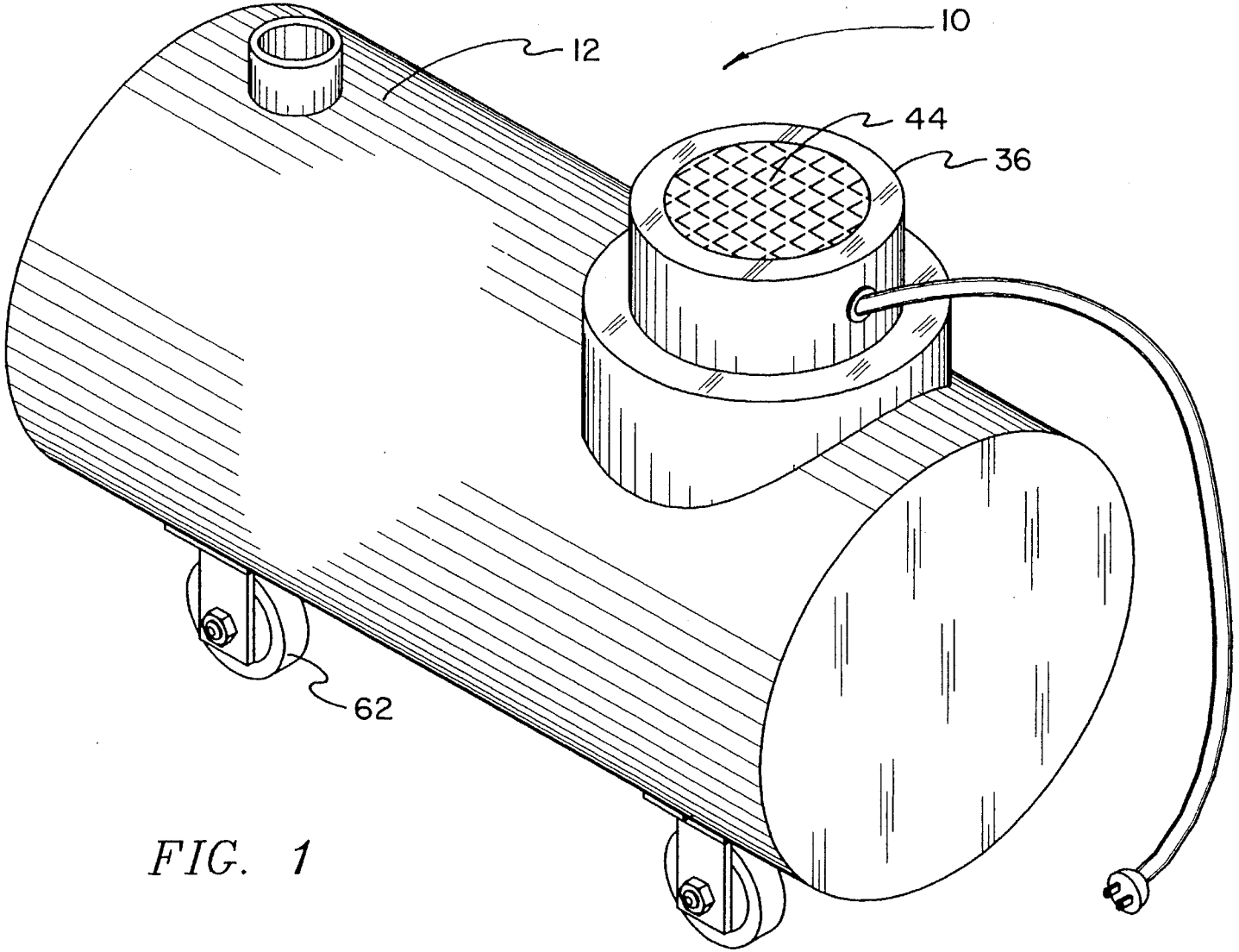
FIG. 1 is a perspective view of the preferred embodiment of the non-tipping wet/dry vacuum constructed in accordance with the principles of the present invention.
Figure 2:
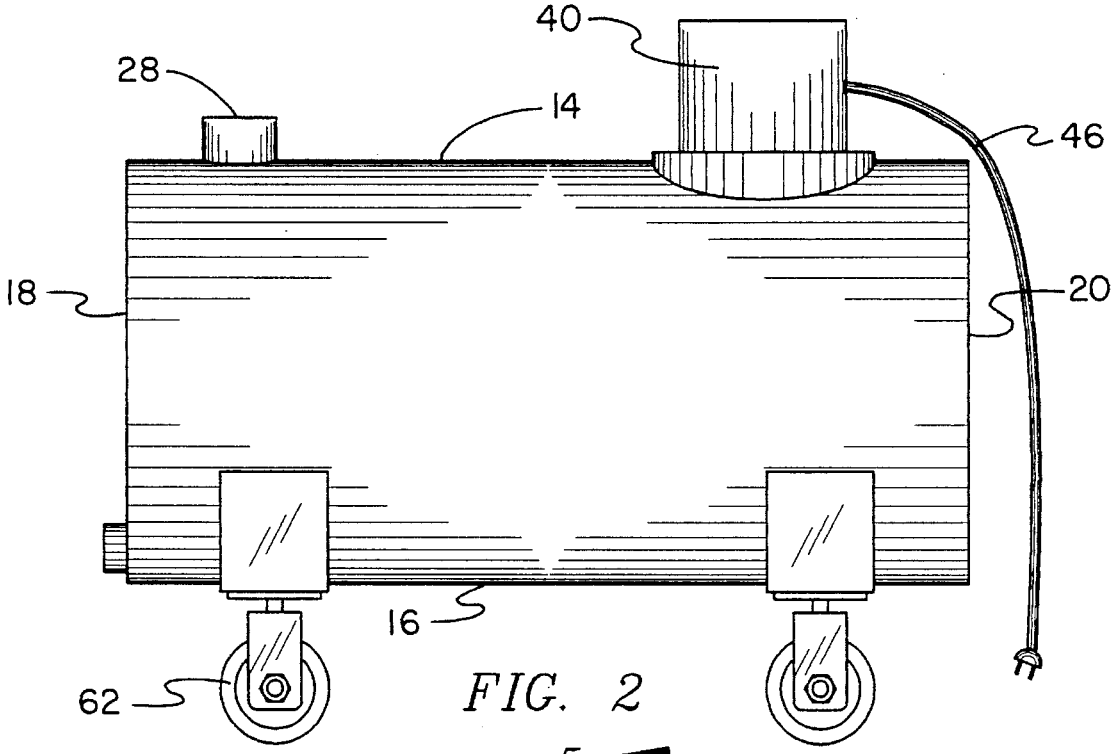
FIG. 2 is a side elevation view of the present invention.
Figure 3:
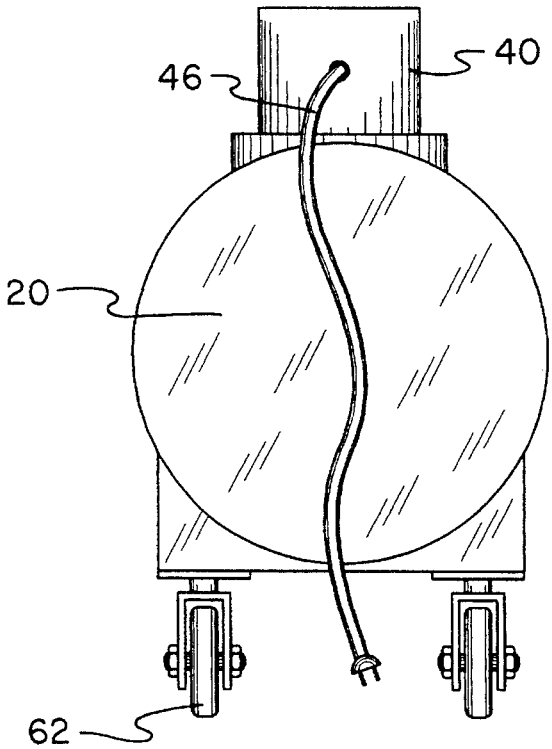
FIG. 3 is a front elevation view of the present invention.
Figure 4:
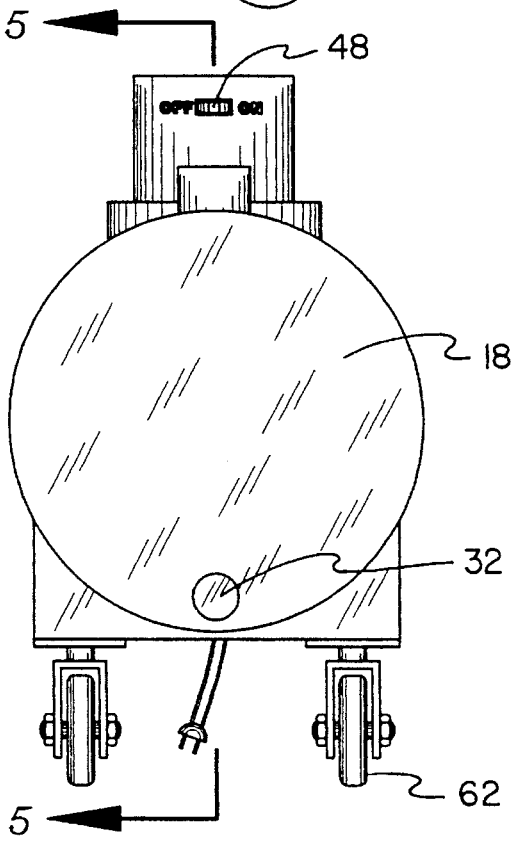
FIG. 4 is a rear elevation view of the present invention.
Figure 5:
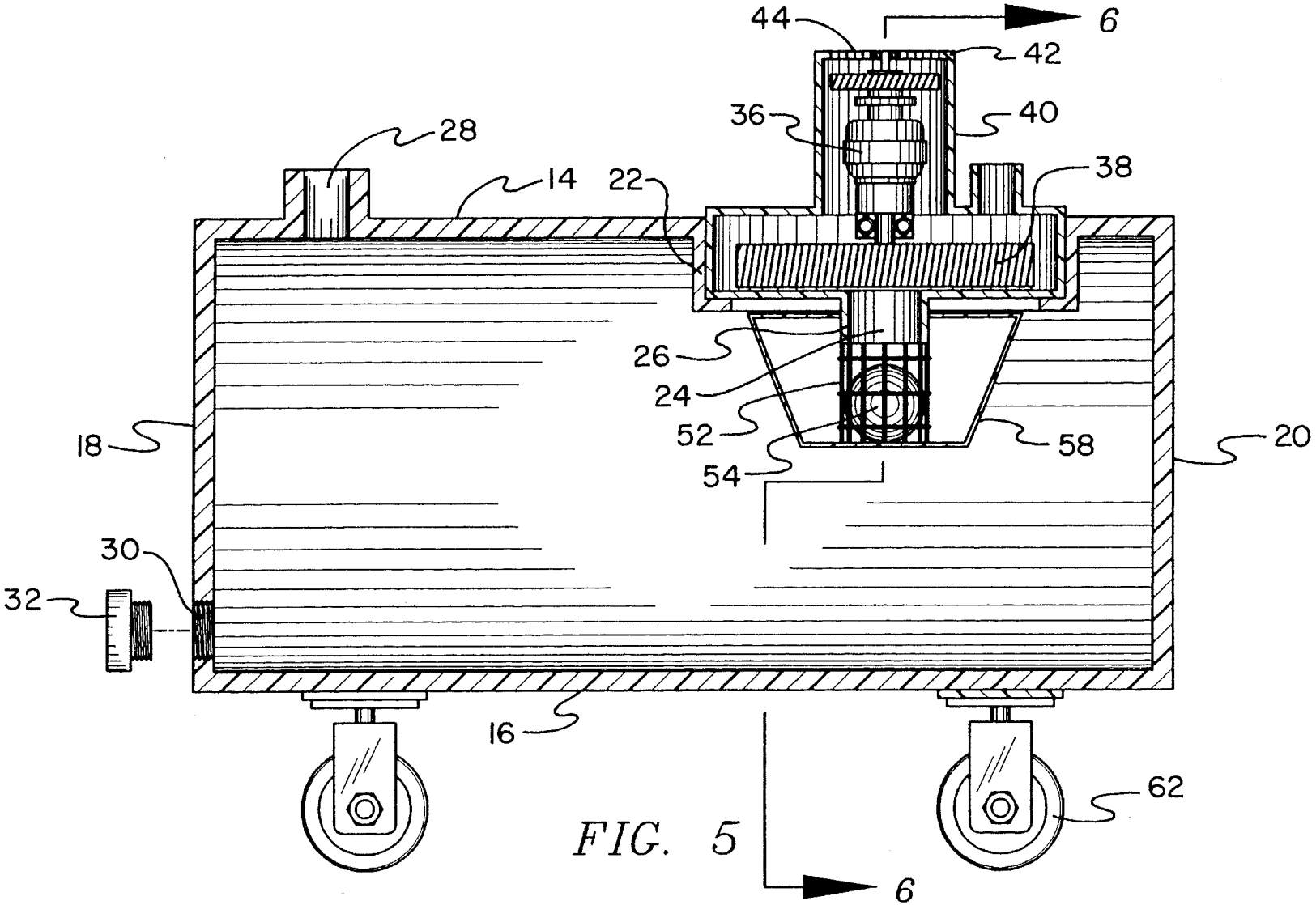
FIG. 5 is a cross-sectional view as taken along line 5—5 of FIG. 4.
Figure 6:
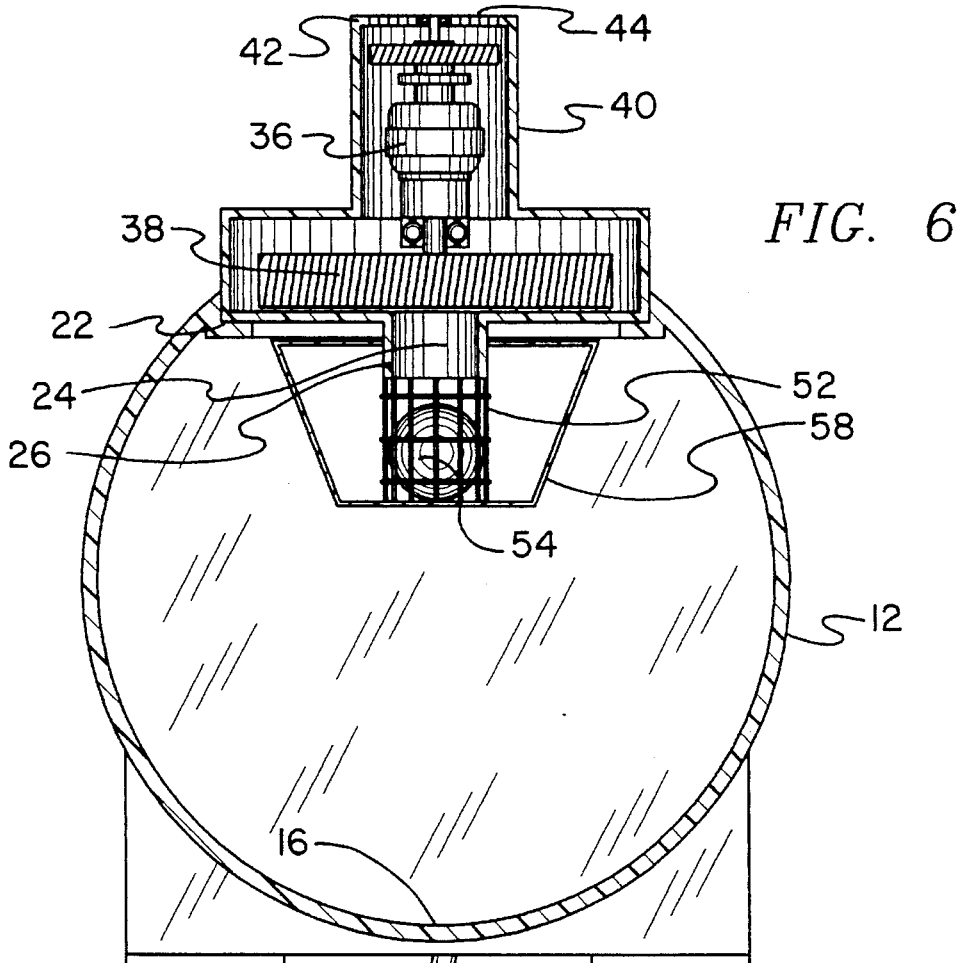
FIG. 6 is a cross-sectional view as taken along line 6—6 of FIG. 5.
Figure 7:
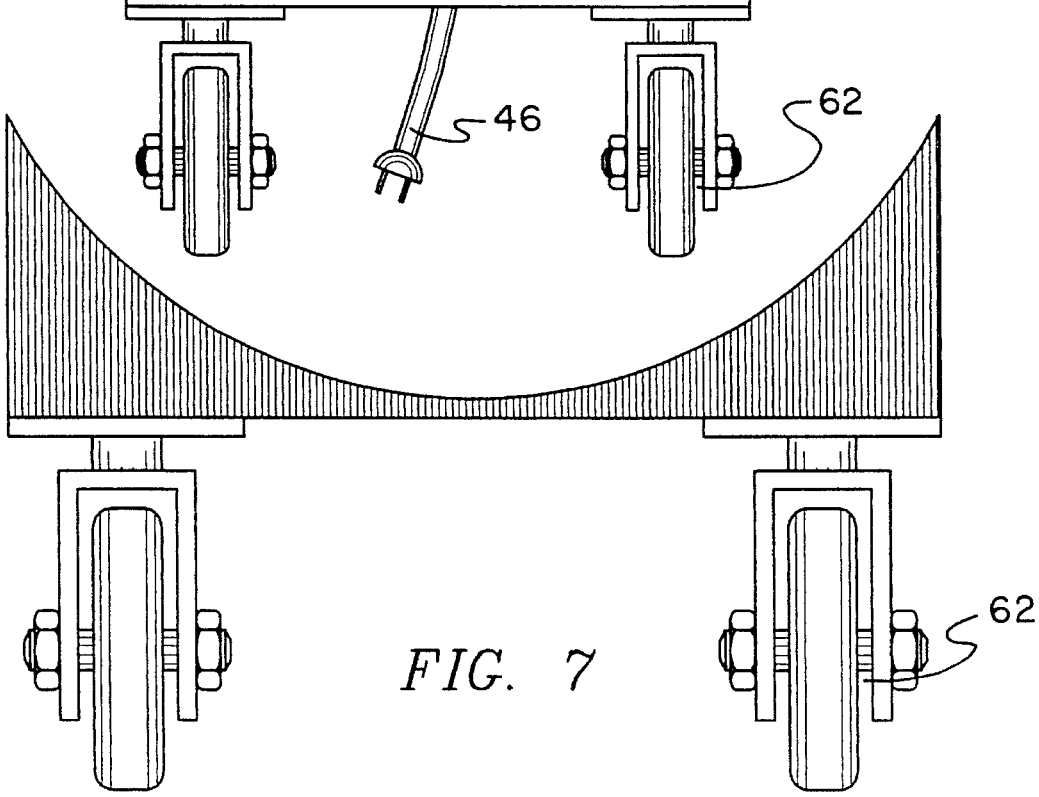
FIG. 7 is a front elevation view of the caster wheels of the present invention.

With reference now to the drawings, and in particular, to FIG. 1–7 thereof, the preferred embodiment of the new and improved non-tipping wet/dry vacuum embodying the principles and concepts of the present invention and generally designated by the reference number 10 will be described.

Specifically, it will be noted in the various Figures that the device relates to a new and improved non-tipping wet/dry vacuum for having a lower center of gravity to prevent tipping over. In its broadest context, the device consists of a cylindrical, horizontally disposed tank, a motor, a lid cage, a trapezoidal ball float container, and four caster wheels.

The device 10 contains a cylindrical, horizontally disposed tank 12 having an upper portion 14, a lower portion 16, a front wall 18, and a rear wall 20. The upper portion 14 has a recess 22 formed therein. The recess 22 has an aperture 24 with a downwardly extending portion 26 formed therethrough. The recess 22 has a length slightly less than half of the overall length of the tank 12. The recess 22 is preferably positioned at a midpoint of the upper portion 14 of the tank 12. The upper portion 14 has a hose inlet 28 inward of the front wall 18 for securement of a hose thereto. The hose inlet 28, by being positioned on the upper portion 14 of the tank, prevents any water spillage from occurring out of the hose inlet 28 if a hose secured thereto becomes loose. The front wall 18 has a threaded aperture 30 formed therethrough adjacent the lower portion 16. The threaded aperture 30 has a plug 32 removably secured thereto. The tank 12 preferably has a capacity of ten gallons for holding both water and dry debris. The tank 12 could also be made in larger or smaller sizes. By pulling the plug 32, the tank 12 can be emptied of water through the threaded aperture 30.

A motor 36 is secured within the recess 22 in the upper portion 14 of the cylindrical, horizontally disposed tank 12. The motor 36 has a impeller disposed above the aperture 24 in the recess 22. The motor 36 has a plastic housing 40 surrounded thereby. A top 42 of the plastic housing 40 has a plastic grid 44 thereon. The plastic grid 44 allows ventilation for the motor 36. The motor 36 has an electric cord 46 extending outwardly of a back portion of the plastic housing 40. The electric cord 46 is adaptable to couple with any standard electrical outlet. The motor 36 has an on/off switch 48 extending outwardly of a front portion of the plastic housing 40. The on/off switch 48 orients the motor 36 in an activated or a de-activated orientation.

A lid cage 52 is secured to the downwardly extending portion 26 from the aperture 24 of the recess 22 of the cylindrical, horizontally disposed tank 12. The lid cage 52 has a floating ball 54 therein. When the motor 36 is activated, suction occurs generated by the motor through the hose inlet 28 of the tank 12. When the tank 12 begins to fill, causing water to rise upwardly, the rising water raises the floating ball 54 upwardly, thereby blocking the downwardly extending portion 26 of the tank causing the suction to cease and preventing the water from entering the recess 22 and causing any damage to the motor 36.

A trapezoidal ball float container 58 is secured to the downwardly extending portion 26 from the aperture 24 of the recess 22 of the cylindrical, horizontally disposed tank 12. The trapezoidal ball float container 58 surrounds the lid cage 52 for protection thereof.

Four caster wheels 62 are secured to peripheral points on the lower portion 16 of the cylindrical, horizontally disposed tank 12. The four caster wheels 62 are preferably secured on metal shafts that extend up into recesses formed in the lower portion 16 of the cylindrical, horizontally disposed tank 12.

The present invention is a wet/dry vacuum with a lower more stable design that will not tip over.

The plastic ten gallon main tank 12 is cylindrical in shape and lays horizontally, rather than upright, on four plastic caster wheels 62 with metal shafts. A 1.25–4 horsepower, plastic-housed motor 36 protrudes upward and is located on the top rear of the tank 12. Underneath the motor 36 is the lid cage 52 and under that is the trapezoidal ball float container 58 that is recessed and enclosed in the tank 12. A six foot grounded electrical cord 46 comes out of the back side of the motor 36 and the on/off switch 48 is on the opposite side. On the top front of the tank 12 is the hose inlet 28. A plug 32 is located on the bottom front to drain water.

This vacuum is used like other shop vacuums and has a longer cord 46 to eliminate the need for an extension cord. When vacuuming water, the ball 54 in the container 58 will gradually rise and cover the hole in the lid cage 52, blocking the water from the motor 36 and stopping the suction if the water rises too high.

Unlike upright vacuums that tend to tip over, sometimes resulting in a cracked tank and spilled water, this device 10 should not fall over because of its lower center of gravity. If the hose should detach, the contents will not leak because the hose inlet 28 is located on the top, above the water level. Using electrical appliances with water nearby is always risky, but using this stable wet/dry vacuum should ensure safer cleaning of both water and dry debris.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and .equivalents may be resorted to, falling within the scope of the invention.

What is claimed as being new and desired to be protected by Letters Patent of the United States is as follows:

1. A non-tipping wet/dry vacuum for having a lower center of gravity to prevent tipping over comprising, in combination:

a cylindrical, horizontally disposed tank having an upper portion, a lower portion, a front wall, and a rear wall, the upper portion having a recess formed therein, the recess having an aperture extending downwardly through, the upper portion having a hose inlet inward of the front wall for securement of a hose thereto, the front wall having a threaded aperture formed therethrough adjacent the lower portion, the threaded aperture having a plug removably secured thereto;

a motor secured within a plastic housing above the recess in the upper portion of the cylindrical, horizontally disposed tank, the motor having an impeller disposed above the aperture in the recess, a top of the plastic housing having a plastic grid thereon, the motor having an electric cord extending outwardly of a back portion of the plastic housing, the motor having an on/off switch extending outwardly of a front portion of the plastic housing;

a lid cage extending downwardly from the aperture of the recess of the cylindrical, horizontally disposed tank, the lid cage having a floating ball therein;

a trapezoidal ball float container secured beneath the aperture of the recess of the cylindrical, horizontally disposed tank, the trapezoidal ball float container surrounding the lid cage for protection thereof; and four caster wheels secured to the lower portion of the cylindrical, horizontally disposed tank adjacent to four peripheral points thereon.

2. A non-tipping wet/dry vacuum for having a lower center of gravity to prevent tipping over comprising, in combination:

a horizontally disposed tank having a recess formed in an upper surface thereof, the recess having an aperture extending downwardly through the tank, the upper surface having a hose inlet for securement of a hose thereto, the tank having a threaded aperture formed through a lower portion thereof, the threaded aperture having plug removably secured thereto;

a motor secured within a plastic housing above the recess in the upper portion of the tank disposed above the aperture in the recess, the motor having an electric cord extending outwardly therefrom, the motor having an on/off switch;

a lid cage extending downwardly from the aperture of the recess of the tank, the lid cage having a floating ball therein;

a trapezoidal ball float container secured beneath the aperture of the recess of the tank, the trapezoidal ball float container surrounding the lid cage for protection thereof; and four caster wheels secured to a lower portion of the tank adjacent to four peripheral points thereon.

* * * * *